United States Patent [19]

Gibas et al.

[11] 4,396,243

[45] Aug. 2, 1983

[54] ELECTRICAL CONNECTOR FOR ELECTROMAGNETIC DEVICE

[75] Inventors: Christoph Gibas, Neunkirchen; Michael Müller, Spiesen, both of Fed. Rep. of Germany

[73] Assignee: bso Steuerungstechnik GmbH, Fed. Rep. of Germany

[21] Appl. No.: 281,386

[22] Filed: Jul. 8, 1981

[30] Foreign Application Priority Data

Jul. 15, 1980 [DE] Fed. Rep. of Germany ..... 3026761

[51] Int. Cl.[3] ..... H01R 4/66

[52] U.S. Cl. ..... 339/14 P; 339/91 R

[58] Field of Search ..... 339/14 R, 14 P, 176 M, 339/91 R

[56] References Cited

U.S. PATENT DOCUMENTS 4,095,073 6/1978 Frank ..... 339/14 P X

FOREIGN PATENT DOCUMENTS 1909368 1/1964 Fed. Rep. of Germany .

2004344 1/1971 Fed. Rep. of Germany .

2832872 2/1980 Fed. Rep. of Germany .

*Primary Examiner*—Eugene F. Desmond

*Attorney, Agent, or Firm*—Roylance, Abrams, Berdo & Farley

[57] ABSTRACT

A connector for providing electrical connections to a coil in an electromagnetic device includes a support member detechably coupled by detents to the bobbin on which the coil is wound. The support members holds an insulating body which receives plug blades connectable to the coil and to a mating connector portion. A holding member forms the ground prong, is mechanically and electrically fastened to the support member and holder the insulating body therebetween.

8 Claims, 13 Drawing Figures

ELECTRICAL CONNECTOR FOR ELECTROMAGNETIC DEVICE

This invention relates to an electrical connector for an electromagnetic device through which electrical connections can be made to a coil incorporated in the device.

BACKGROUND OF THE INVENTION

It is well known that an electromagnetic device, such as a switching magnet, requires some technique for connecting external conductors to the ends of the coil in the device. With a known device, a plug connected to the ends of a coil wound around a coil bobbin or spool are physically supported only by the coil wire itself. This arrangement has the disadvantage that there is considerable danger of damage to the connections or to the coil itself with an assembly of that type.

BRIEF DESCRIPTION OF THE INVENTION

Accordingly, an object of the present invention is to provide a plug for making electrical connections to the coil wherein the plug itself is securely mounted. A further object is to provide an apparatus in which the plug is securely, although releaseably, mechanically attached to the coil spool.

Briefly described, the invention comprises a device for the connection of the ends of a coil wound on a coil spool of a switching magnet having a cover plate comprising the combination of a support member, detent means on the coil spool for detachably holding the support members, means on the support member for connection to the cover plate, first and second electrically conducted plug arms electrically connectable to the ends of the coil wound on the spool, a body of insulating material attached to the support member, the body having means for receiving and supporting the plug arms so that the arms protrude in generally parallel relationship, a grounding prong, and means for mechanically and electrically attaching the grounding prong to the support member so that the prong extends in generally parallel relationship with the arms.

In this structure, the insulating body forms a plug socket and the support member supporting it from the major part of the plug assembly, including the grounding connection. A secure plug assembly is thus attained in which there is very little danger of damage to the mounting. Also, a mechanically secure connection is possible with the grounding connection. The support member can be attached to and detached from the coil spool in a simple manner.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
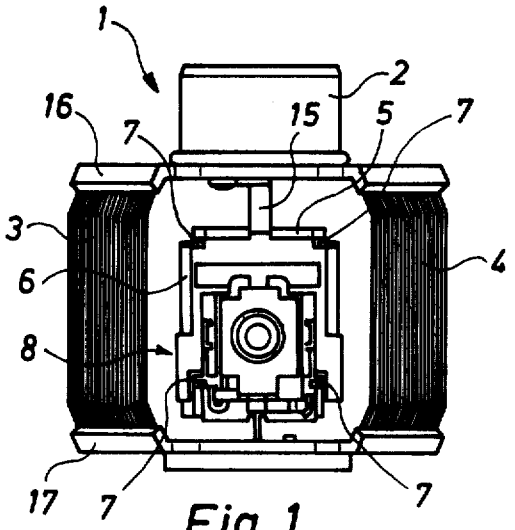
FIG. 1 is a side elevation of a device incorporating a connector in accordance with the present invention.

As seen in FIG. 1, an electromagnetic device with which the apparatus of the present invention is used is shown as an alternating current magnetic device indicated generally at 1 having a magnetic pole tube 2 with an inside pole core. Around pole tube 2 are arranged four intersecting bundles of laminations of which bundles 3 and 4 are visible in FIG. 1. Within these bundles is a coil 6 wound around a coil spool or bobbin 5. Coil spool 5 is provided with an arrangement of four detents 7 which, as seen in FIG. 1, are arranged at corners of a rectangle with two of the detents being arranged on a top flange 51 of the bobbin and the other two being provided on a botton flange 52 of the bobbin, the detents serving the purpose of supporting a device indicated generally at 8 which is a connector for the connection of the two ends of the wire forming coil 6 which is wound around coil spool 5, the device having two protruding plug arms 12 and 13. The connector portion of this device is shown at an enlarged scale in FIGS. 2–4.

Figure 7:
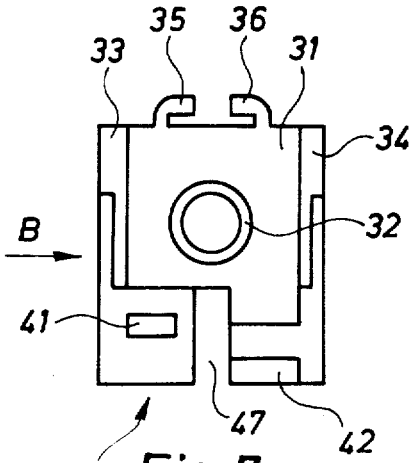
FIGS. 7,8 and 9 are front elevation, side elevation, and bottom plan views of an insulating plug socket portion of the apparatus of FIGS. 2–4, shown apart from the other components.
Figure 8:
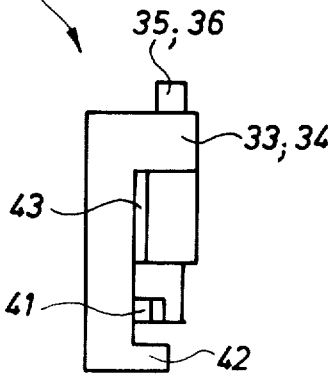
Figure 9:
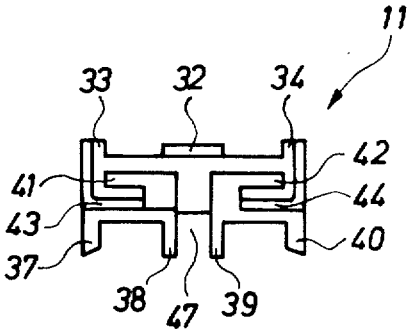
Figure 12:
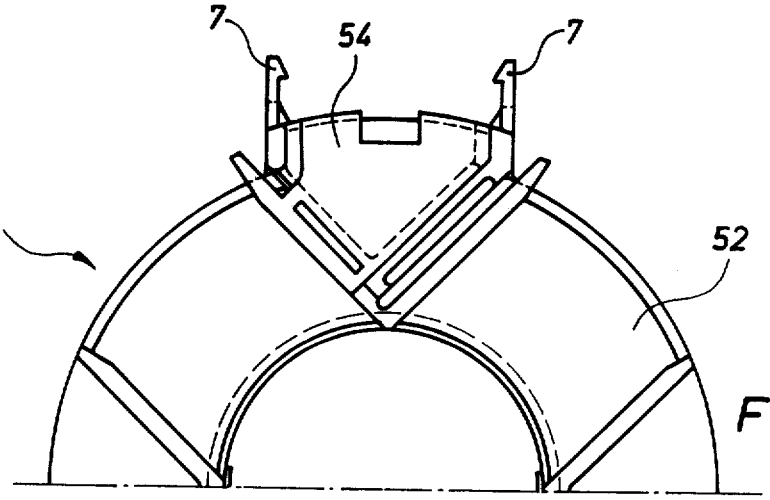
FIG. 12 is a partial bottom plan view of the apparatus of FIGS. 10 and 11, in the direction of arrow C.
Figure 10:
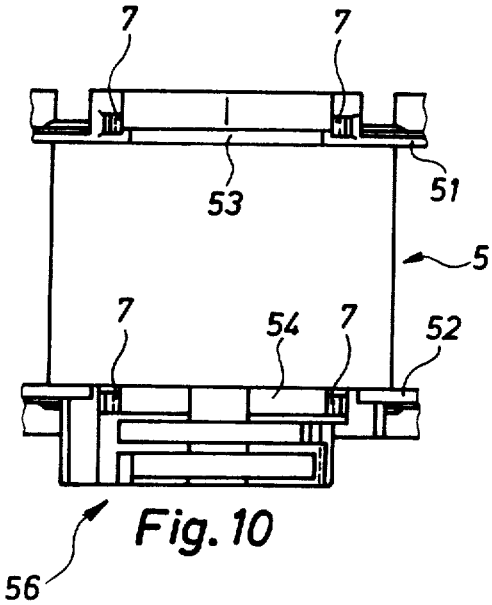
FIG. 10 is a front elevation of a coil spool structure usable in the apparatus of FIG. 1 and with the apparatus of FIGS. 2–4.
Figure 11:
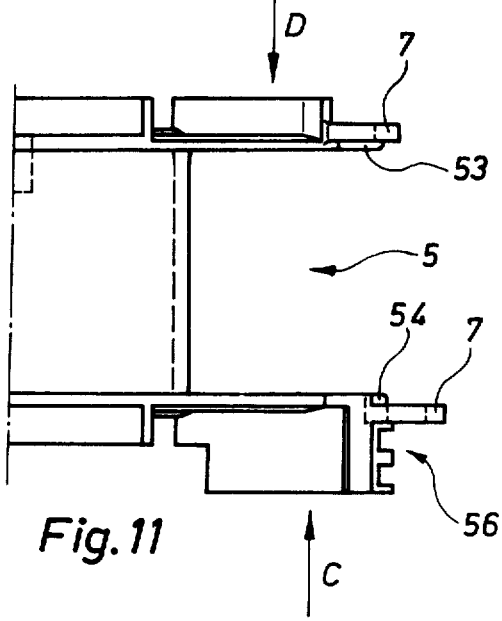
FIG. 11 is a partial side elevation of the spool of FIG. 10.
Figure 13:
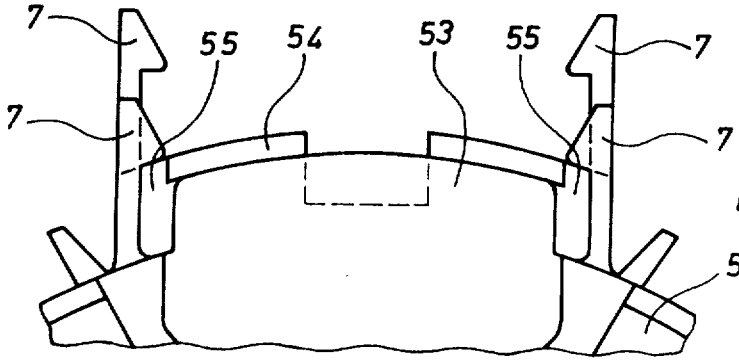
FIG. 13 is a top plan view of the apparatus of FIGS. 10–12 in the direction of arrow D.

The connector device includes a support member 9 which is made of sheet metal and is arched, resembling a portion of a hollow cylindrical cover. A holder 10, which is mechanically and electrically connected with support member 9 at one end by welding, also consists of sheet metal. A body of insulating material forms a plug socket 11 which is disposed between support member 9 and holder 10. Plug arms 12 and 13, which are electrically conducted, are inserted into and supported by plug socket 11. A ground prong 14 is formed intergrally with holder 10. Support member 9 is shown by itself, in FIG. 5, and one of the plug arms 12,13 is separately shown in FIG. 6. The insulating body forming plug socket 11 is shown in FIGS. 7–9.

Support member 9 has a vent connection part 15 at the top thereof which has, at its upper end, an eyelet to permit connection by a rivet or screw to cover plate 16 at the top of the device. The cover plate forms one end of the apparatus and engages the upper surfaces of the bundles of laminations 3,4 in the magnetic structure. A cover plate 17 of the same configuration is provided at the bottom end of the bundles of laminations. The connection between part 15 and cover plate 16 is preferably by a rivet type of fastener.

Figure 5:
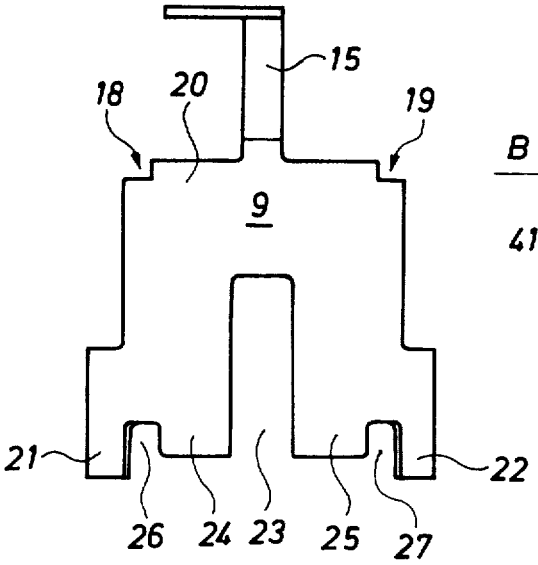
FIG. 5 is a front elevation of the support member portion of the apparatus of FIGS. 2–4 separate from the other components.
Figure 6:
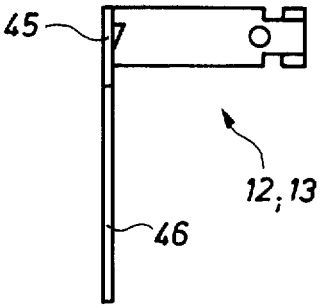
FIG. 6 is a side elevation of a plug arm usable in the apparatus of FIGS. 2–4, apart from the other components.

Support member 9, as shown in FIG. 5, has two essentially rectangular cutouts 18,19 on the end toward connection 15, which cutouts serve for the engagement of the detents 7 provided on the top flange 51 of coil spool 5. The edge 20 between the cutouts is provided for abutting against the coil spool flange. On the opposite side of the support member are found two support wings 21,22 which can abut bottom flange 52 of the coil body. A notch 23 extends upwardly into the middle of the support member from the bottom edge thereof to hold a portion of the plug socket 11. Adjacent this notch on opposite side are found mounting projections 24 and 25 which are also for mounting against the bottom flange 52 of coil spool 5. Between support wing 21 and mounting point 24 is provided a notch 26, and a similar notch 27 is provided between support wing 22 and mounting point 25. Projections on the bottom flange 52 between detents 7 project into notches 26, 27. The detents 7 on the bottom flange 52 engage in plug socket 11, as will be described.

Figure 4:
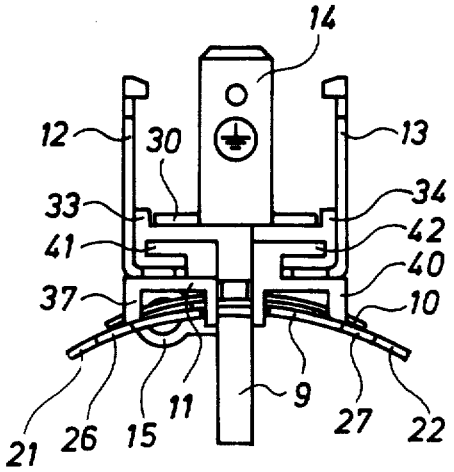
FIG. 4 is a bottom plan view in the direction of arrow A of FIG. 3.
Figure 2:
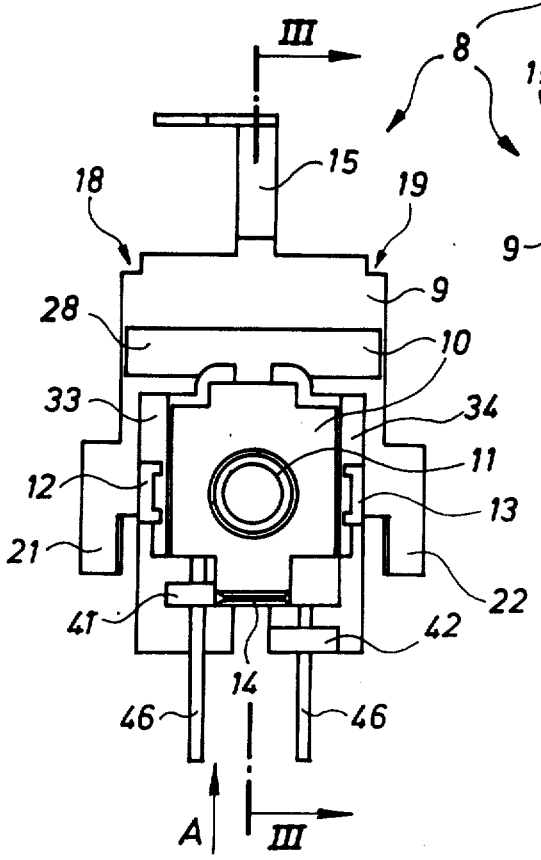
FIG. 2 is an enlarged view of the connector portion of the apparatus removed from the electromagnetic device shown in FIG. 1.
Figure 3:
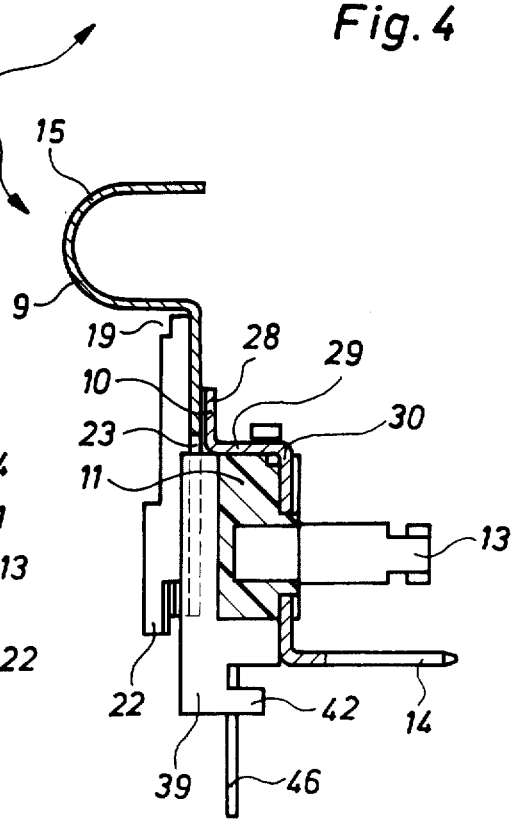
FIG. 3 is a side elevation along line III—III of FIG. 1.

Holder 10, which is shown in FIGS. 2,3 and 4 is multisurfaced. It has an attachment part 28 which lies adjacent to a surface of support member 9 and is welded thereto, portion 28 being arranged parallel to the middle part of support member 9. That portion of holder 10 which overlies the front surface of plug socket 11 has a circular central opening for receiving a projection 32 which is part of member 11. Finally, the distal end of member 10 forms a grounding prong 14 which is parallel to, but at the opposite end of the member from, cross piece 29.

Plug socket 11, in overall shape is essentially rectangular. It is provided with a mounting area on the surface facing the viewer in FIG. 2 for plate 30 which is a part of holder 10 and in the middle of the mounting area 31 it is provided with a tubular projection 32 as a molded end part (FIG. 7). Projecting side strips 33, 34 are provided to the left and right of mounting area 31. Two hook-shaped projections 35,36 form hooks opening toward each other at the top of member 11 between which is inserted cross piece 29 of holder 10.

As seen in FIG. 9, member 11 is provided with flanges 37,38,39 and 40 which project from the bottom of the plug holder, flanges 37 and 40 being bevelled to engage on the curved outer surface of support member 9, and flanges 38, 39 of which are opposite each other and are dimensioned to be received in notch 23 of support member 9. Hooked members 41,42 are provided between flanges 37 and 40 and the projection 32 and are offset from each other and open outwardly as illustrated in FIGS. 7 and 9. On both sides of plug socket 11 are notches 43,44 to receive plug arms 12,13.

Each of plugs 12,13 has a downwardly angled plug foot 45 which includes a one-sided projecting detent and on which is found a connection lug 46 which serves as the electrical connection point for one end of the wire of coil 6. As shown in FIG. 4, plug 12 with its plug foot 45 is inserted into the cutout or recess 43 with relatively little pressure and plug 13 is plugged in with its plug foot in cutout 44. Contact lug 46 of each of the plug feet is connected with each end of the wire forming coil 6. The relevant contact 46 of plug 12,13 is inserted through one of hooks 41 and 42, and the connection is made within the hook part 41 or 42. Between flanges 38 and 39 is a notch 47 which extends almost to the mounting area 31.

Detents 7 are shown separately in FIGS. 10–13. As seen therein, the detents extend at an angle to the radius of the coil spool, but extend in parallel relationship to each other. Detents 7 on each of flanges 51,52 face each other. Projections 53,54 are provided at different spacings between detents 7 on flanges 51,52. They serve for the mounting of support member 9 at different points. A notch 55 is provided on each side of the smaller projections 54 between these projections and the detents.

Detents 7 on bottom flange 52 project radially outwardly further than detents 7 on top flange 51. Between detents 7 on bottom flange 52 are two pockets 56, each of these pockets being able to receive one contact at the end of a wire forming the coil.

The disclosed structure which is generally intended for use as a switching magnet, can also be a direct current magnet.

While certain advantageous embodiments have been chosen to illustrate the invention it will be understood by those skilled in the art that various changes and modifications can be made therein without departing from the scope of the invention as defined in the appended claims.

What is claimed is:

1. A device for the connection of the ends of a coil wound on a coil spool of a switching magnet having a cover plate comprising the combination of a support member;

detent means on said coil spool for detachably holding said support member;

means on said support member for connection to said cover plate;

first and second electrically conductive plug arms electrically connectable to the ends of the coil wound on the spool;

a body of insulating material attached to said support member, said body having means for receiving and supporting said plug arms so that said arms protrude in generally parallel relationship;

a grounding prong; and means for mechanically and electrically attaching said prong to said support member so that said prong extends in generally parallel relationship with said arms.

2. A device according to claim 1 wherein said means for attaching said prong includes a holder extending in generally parallel relationship with said support member with said body of insulating material therebetween;

means in said holder defining an opening therethrough; and a projection on said insulating material extending through said opening.

3. A device according to claim 2 wherein said support member is formed from sheet metal and includes means for engaging said detent means on said spool; and means defining a notch for engaging said insulating body;

and wherein said means for connection to said cover plate includes an arcuately bent member on said support.

4. A device according to claim 3 wherein said insulating body includes a flange for engaging said notch in said support member, and means defining first and second recesses for receiving portions of said plug arms.

5. A device according to claim 4 wherein each of said plug arms includes an elongated connection member for connection to one end of said coil, and said insulating body includes first and second outwardly opening hook members for receiving said connection members.

6. A device according to claim 5 wherein each of said plug arms is formed from sheet metal and includes a bent-out projection for holding said arm in said insulating body.

7. A device according to any one of claims 1 through 6 wherein said coil spool includes flange members at opposite ends of said coil, each said flange member having a pair of protruding detent members extending parallel with each other and at an angle to the spool radii, the detent members on one flange member being axially substantially aligned with those on the other flange member.

8. A device according to claim 7 wherein each of said flange members further includes a projection extending radially outwardly between and spaced from said detent members.

* * * * *